US011778700B2

(12) United States Patent
Jenkins

(10) Patent No.: US 11,778,700 B2
(45) **Date of Patent: *Oct. 3, 2023**

(54) FLAMMABILITY OF HEATING CABLE

(71) Applicant: nVENT SERVICES GmbH, Schaffhausen (CH)

(72) Inventor: Sirarpi B. Jenkins, Menlo Park, CA (US)

(73) Assignee: nVent Services GmbH, Schaffhausen (CH)

( * ) Notice: Subject to any disclaimer, the term of this patent is extended or adjusted under 35 U.S.C. 154(b) by 945 days.

This patent is subject to a terminal disclaimer.

(21) Appl. No.: 16/708,173

(22) Filed: Dec. 9, 2019

(65) Prior Publication Data

US 2020/0187308 A1 Jun. 11, 2020

Related U.S. Application Data

(60) Provisional application No. 62/776,592, filed on Dec. 7, 2018.

(51) Int. Cl.
*H05B 3/56* (2006.01)

(52) U.S. Cl.
CPC ..... *H05B 3/565* (2013.01); *H05B 2203/017* (2013.01); *H05B 2203/02* (2013.01)

(58) Field of Classification Search
CPC ..... H05B 3/565; H05B 3/04; H05B 3/146; H05B 3/56; H05B 1/0291; H05B 1/02; H05B 2203/011; H05B 2203/02; H05B 2203/017; Y02A 30/14; H01B 7/28; H01B 7/295; H01B 3/441
See application file for complete search history.

(56) References Cited

U.S. PATENT DOCUMENTS

| | | | |
|---|---|---|---|
| 4,271,350 | A | 6/1981 | Crowley |
| 4,309,596 | A | 1/1982 | Crowley |
| 6,563,990 | B1 | 5/2003 | Hurley et al. |
| 6,714,710 | B2 | 3/2004 | Gimblet |
| 8,097,809 | B2 | 1/2012 | Galletti et al. |
| 8,422,843 | B2 | 4/2013 | Kachmar |
| 9,115,273 | B2 | 8/2015 | Perez et al. |
| 9,378,868 | B2 | 6/2016 | Flenniken |
| 9,482,835 | B2 | 11/2016 | Granger et al. |
| 9,529,170 | B2 | 12/2016 | Sutehall et al. |
| 9,773,585 | B1 | 9/2017 | Rogers |
| 10,025,053 | B2 | 7/2018 | Hudson, II et al. |
| 10,283,239 | B2 | 5/2019 | Rogers |

(Continued)

FOREIGN PATENT DOCUMENTS

| | | | |
|---|---|---|---|
| CN | 103440921 | A | 12/2013 |
| CN | 103985472 | A | 4/2014 |

(Continued)

*Primary Examiner* — Shawntina T Fuqua

(74) *Attorney, Agent, or Firm* — Quarles & Brady LLP

(57) ABSTRACT

Embodiments of the invention provide a self-regulating heating cable. The cable includes a primary jacket including a first low-smoke, zero halogen material. The cable also includes a braid surrounding the primary jacket. The cable also includes a final jacket surrounding the braid and comprising a second low-smoke, zero halogen material. The final jacket is formed to the braid during an extrusion process in order to create a mated connection between the final jacket and the braid.

20 Claims, 9 Drawing Sheets

(56) References Cited

U.S. PATENT DOCUMENTS

| | | | | |
|---|---|---|---|---|
| 2004/0096166 | A1 | 5/2004 | Rossi et al. | |
| 2014/0037956 | A1* | 2/2014 | Sopory | H05B 3/56 428/394 |
| 2015/0268430 | A1 | 9/2015 | Bringuier et al. | |
| 2016/0018612 | A1 | 1/2016 | Czosnowski et al. | |
| 2017/0153405 | A1 | 6/2017 | Bringuier et al. | |
| 2017/0192189 | A1 | 7/2017 | Gonzalez et al. | |
| 2018/0174710 | A1 | 6/2018 | Rogers | |
| 2018/0220495 | A1 | 8/2018 | Jenkins et al. | |
| 2018/0224619 | A1 | 8/2018 | Debban et al. | |
| 2018/0306992 | A1 | 10/2018 | Hudson, II et al. | |

FOREIGN PATENT DOCUMENTS

| | | | | | |
|---|---|---|---|---|---|
| CN | 204305377 | U | | 4/2015 | |
| CN | 104681159 | A | | 6/2015 | |
| CN | 106128598 | B | * | 4/2018 | H01B 7/1875 |
| CN | 217767940 | U | * | 11/2022 | |
| EP | 0536165 | A1 | | 4/1993 | |
| GB | 2294801 | A | | 6/1996 | |
| WO | 0133908 | A1 | | 5/2001 | |
| WO | 2016075120 | A1 | | 5/2016 | |
| WO | 2018142214 | A1 | | 8/2018 | |
| WO | WO-2021073272 | A1 | * | 4/2021 | H01B 13/00 |

* cited by examiner

FLAMMABILITY OF HEATING CABLE

CROSS-REFERENCE TO RELATED APPLICATIONS

This application is based on, claims priority to, and incorporates herein by reference in its entirety, U.S. Provisional Application Ser. No. 62/776,592, filed Dec. 7, 2018, and entitled "Improving Flammability of Low Smoke Zero Halogen Jacketed Heating Cable."

BACKGROUND OF THE INVENTION

Self-regulating heating cables generally include two conductor wires embedded in a heating core made of a semiconductive polymer having a resistivity with a positive temperature coefficient (i.e., a "PTC material"). The core creates electrical paths between the conductor wires and heat is generated in the PTC material as electric current passes through these electrical paths between the conductor wires. However, the number of microscopic parallel electrical paths between the wires changes in response to temperature fluctuations. In particular, as the ambient temperature drops, the core contracts microscopically. This contraction decreases the core's electrical resistance and creates numerous microscopic electrical paths between the wires. Current then flows across these paths to warm the core. Conversely, as the ambient temperature rises, the core expands microscopically, decreasing the number of microscopic electrical paths and increasing electrical resistance between the wires so that less heat is produced.

The heating core is surrounded by multiple layers, including electrical and thermal insulation layers, ground plane layers, mechanical and chemical barriers, etc. Many self-regulating heating cables use, within various layers, materials that can function as a flame retardant. For example, the cable may have a final jacket layer that can function as a flame retardant among other functions. The final jacket layer can expand during a flame application and lose contact with the layer underneath, such as a braid. When the jacket layer is in contact with the braid, the braid can act as a heat sink to lower the temperature of the final jacket and/or aid in flammability protection for the cable. The braid cannot function as a heat sink when the final jacket layer loses contact with the braid.

SUMMARY OF THE INVENTION

A self-regulating heating cable with improved contact between a jacket layer and a braid for improved flammability protection is desired. In order to achieve better flame retardation with a low smoke zero halogen (LSZH) material, one could increase the amount of flame retardant in the formulation; however, the amount of mineral filler one could incorporate into an LSZH formulation is limited by the processability and mechanical properties of the formulation. Instead, the flammability response of LSZH jacketed cables can be significantly improved without a material change but by forming the final jacket to the braid during extrusion.

Embodiments of the invention provide a self-regulating heating cable. The cable includes a primary jacket including a first low-smoke, zero halogen material. The cable also includes a braid surrounding the primary jacket. The cable also includes a final jacket surrounding the braid and comprising a second low-smoke, zero halogen material. The final jacket is formed to the braid during an extrusion process in order to create a mated connection between the final jacket and the braid.

These and other aspects of the invention will become apparent from the following description. In the description, reference is made to the accompanying drawings which form a part hereof, and in which there is shown embodiments of the invention. Such embodiments do not necessarily represent the full scope of the invention and reference is made therefore, to the claims herein for interpreting the scope of the invention.

DETAILED DESCRIPTION OF PREFERRED EMBODIMENTS

Before embodiments of the invention are described in further detail, it is to be understood that the invention is not limited to the particular aspects described. It is also to be understood that the terminology used herein is for the purpose of describing particular aspects only and is not intended to be limiting. The scope of an invention described in this disclosure will be limited only by the claims. As used herein, the singular forms "a", "an", and "the" include plural aspects unless the context clearly dictates otherwise.

It should be apparent to those skilled in the art that many additional modifications beside those already described are possible without departing from the inventive concepts. In interpreting this disclosure, all terms should be interpreted in the broadest possible manner consistent with the context. Variations of the term "comprising", "including", or "having" should be interpreted as referring to elements, components, or steps in a non-exclusive manner, so the referenced elements, components, or steps may be combined with other elements, components, or steps that are not expressly referenced. It should be appreciated that aspects of the invention that are described with respect to a system are applicable to the methods, and vice versa, unless the context explicitly dictates otherwise.

Figure 1:
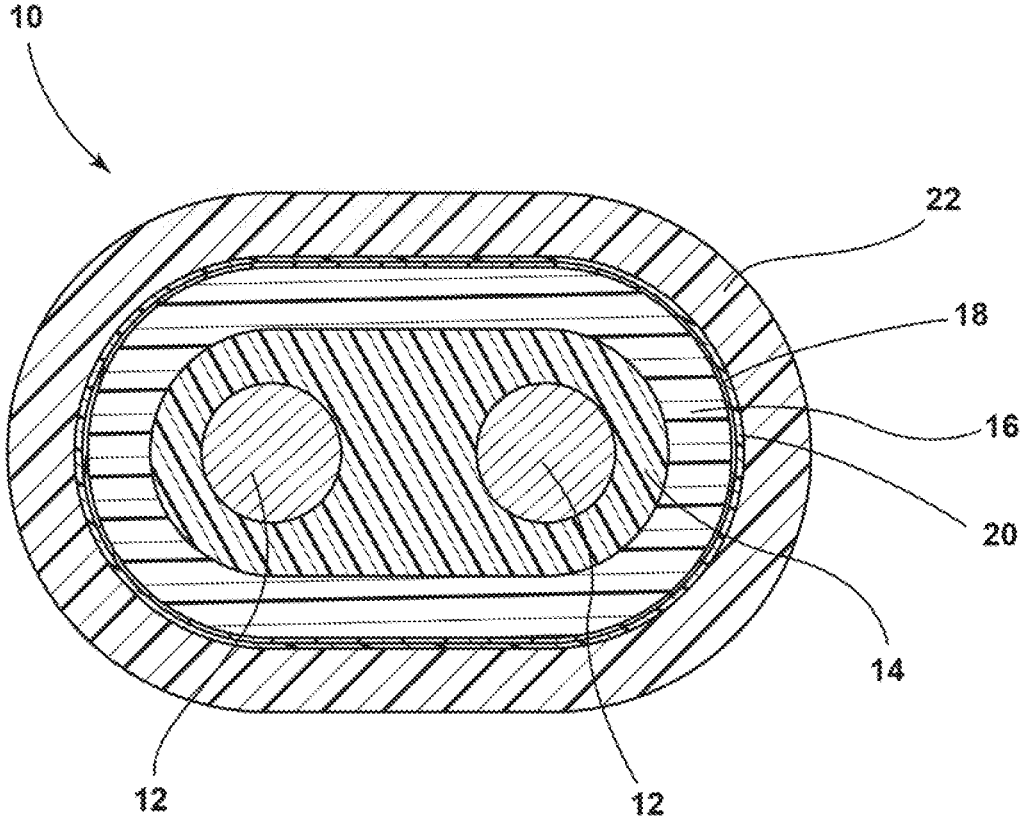
FIG. 1 is a cross-sectional view of a self-regulating heating cable according to some embodiments of the invention.

FIG. 1 illustrates a self-regulating heating cable 10 according to some embodiments of the invention. The cable 10 includes parallel conductor wires 12, a core 14, a primary jacket 16, an optional barrier layer 18, a braid 20, and a final jacket 22. The conductor wires 12 can be made of nickel-coated copper and are surrounded by the core 14, which can be made of a semi-conductive polymer material. More specifically, the core 14 can be made of positive temperature coefficient (PTC) material comprising one or more polymers mixed with conductive carbon black or another suitable conductive filler. This blend of materials can create microscopic electrical paths for conducting current between the parallel conductor wires 12 along the length of the cable 10. The number of electrical paths can change in response to ambient temperature fluctuations. In particular, as the ambient temperature drops, the core 14 contracts microscopically. This contraction decreases the core's electrical resistance and creates numerous microscopic electrical paths between the wires 12. Current can then flow across these paths between the wires 12 to warm the core 14. Conversely, as the ambient temperature rises, the core 14 expands microscopically, decreasing the number of microscopic electrical paths and increasing electrical resistance between the wires 12 so that less heat is produced.

As shown in FIG. 1, the core 14 can be coated by the primary jacket 16, which can be an electrically-insulating polymer compound. In one embodiment, the primary jacket 16 can have a nominal thickness of about 0.033 inches. However, other thicknesses may be contemplated in other embodiments. On top of the primary jacket 16, the optional barrier layer 18 can act as a barrier for the interior components (e.g., protecting them from water and/or chemicals). The barrier layer 18 can be a metallic foil, such as aluminum foil. The braid 20 (e.g., a tinned-copper or other metallic braid) surrounds the aluminum foil 18 or the primary jacket 16 and acts as a ground path. The braid 20 can also act as a heat sink. The braid 20 can include one or more metals such as tinned-copper. On top of the braid 20, the final jacket 22 acts as a mechanical protection layer, and can have a nominal thickness of about 0.021 inches, in one embodiment.

In some embodiments, the core 14, the primary jacket 16, and/or the final jacket 22 can be cross-linked. Generally, cross-linking can increase performance, strength, stability, and/or longevity of the cable 10. For example, cross-linking the core 14 can prevent a negative temperature coefficient (NTC) effect at temperatures above the melt temperature of the core 14. Cross-linking the primary jacket 16 and/or the final jacket 22 can increase performance such as thermal, chemical, and abrasion resistance, as well as other mechanical properties, and increase the softening temperature of the material. In some applications with higher temperature ratings, cross-linking the final jacket 22 can help the cable 10 meet the higher temperature rating. Cross-linking can be achieved in some embodiments by electron beam (e-beam) irradiation, peroxide cross-linking, silane cross-linking, or other methods, and can be performed during or after extrusion.

Regarding the primary jacket 16 and the final jacket 22, a wide range of materials have been used in existing heating cables similar to the heating cable 10. When flammability resistance is required, such existing cables use materials, such as a polyolefin with a flame retardant or fluoropolymer that contains a halogen in the formulation and/or cannot be considered low smoke. In contrast, some embodiments of the invention provide a low smoke, zero halogen (LSZH) self-regulating heating cable 10. More specifically, the heating cable 10 can have a primary jacket 16 and a final jacket 22 that are made to conform to the International Electrotechnical Commission (IEC) 60754-1 standard, which specifies a procedure for determining the amount of halogen acid gas evolved during material combustion, and the IEC 61034 standard for "low" smoke emission, or similar standards.

Figure 2:
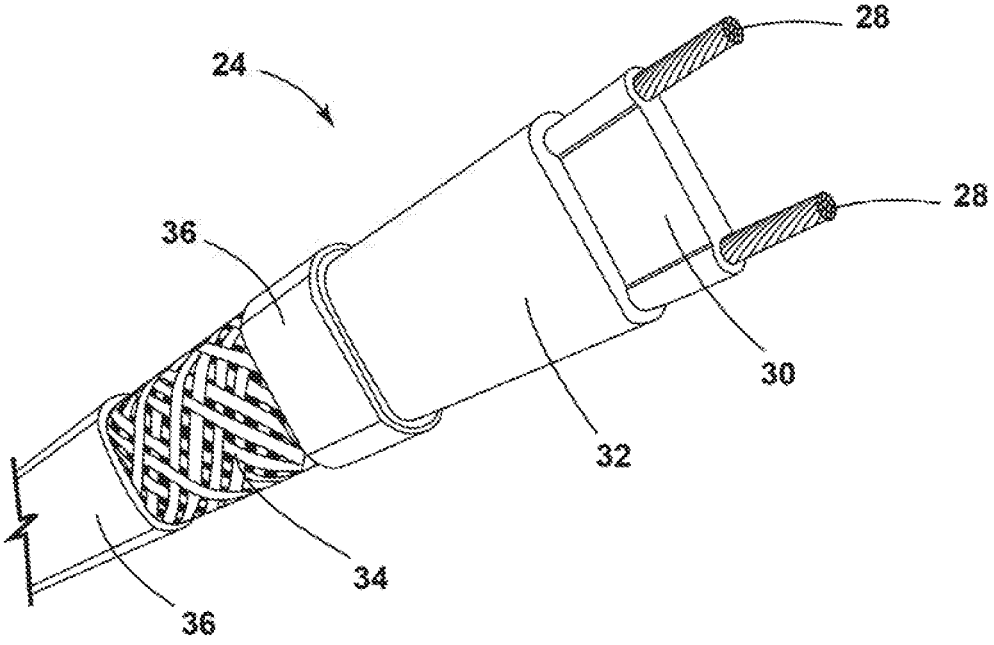
FIG. 2 is a perspective cutaway view of a low smoke, zero halogen (LSZH) self-regulating heating cable according to one embodiment of the invention.
Figure 3:
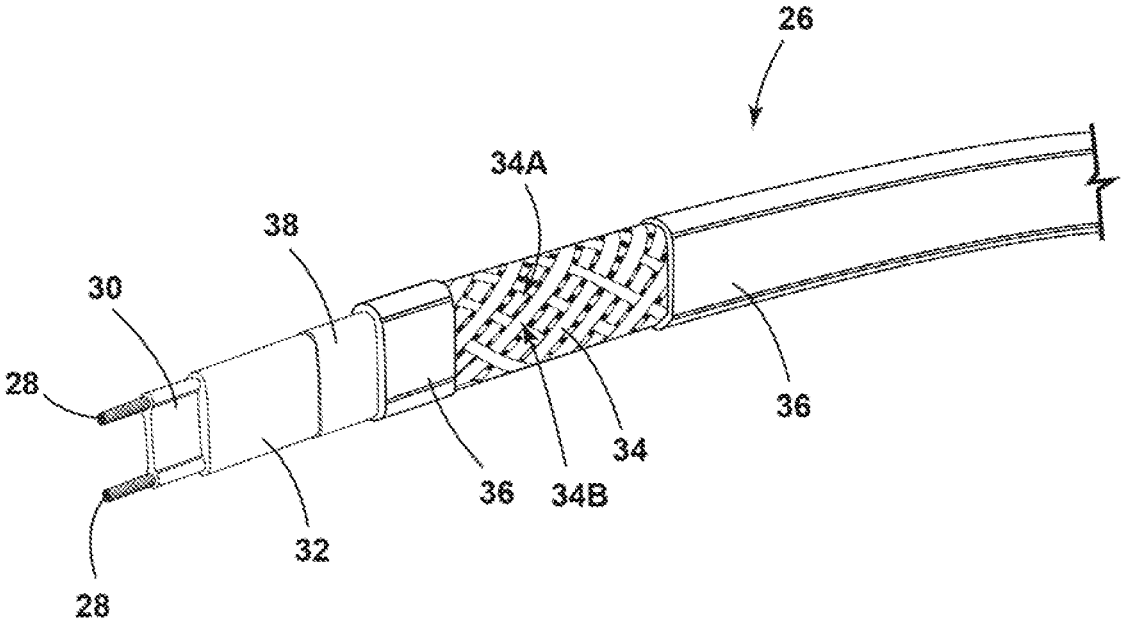
FIG. 3 is a perspective cutaway view of an LSZH self-regulating heating cable according to another embodiment of the invention.

As shown in FIGS. 2 and 3, a primary jacket 32 and/or a final jacket 36 of cables 24, 26 are made of or include an LSZH compound. As a result, the cables 24, 26 contain no halogen (i.e., in any components) and may be considered low smoke (e.g., burns cleanly with less smoke generation). The materials of a core 30, primary jacket 32, and/or final jacket 36 may be cross-linked. However, while cross-linking provides benefits, such as improved resistance to heat deformation, abrasion, and chemicals, it is an additional step in the manufacturing process and has attendant material, equipment, labor, and quality assurance costs. Further, experimentation has shown that cross-linking the material does not improve the LSZH properties of the heating cable 24. Therefore, in some embodiments, one or more of the core 30, the primary jacket 32, and the final jacket 36 may not be cross-linked to maintain a relatively low manufacturing cost. For example, the primary jacket 32 may be cross-linked in order to tolerate higher temperatures due to the proximity to the core 30, but the final jacket 36 may not be cross-linked because it is not subjected to such high temperatures. In some embodiments, the core 30 may also be a zero-halogen material.

Generally, an LSZH compound may include polyolefins flame retarded with inorganic hydrated mineral fillers, such as aluminum trihydrate and magnesium hydroxide. For example, in one embodiment, the LSZH compound is an ECCOH™ engineered polymer compound manufactured by PolyOne Corporation. However, other LSZH compounds may be used in other embodiments. For example, any of the layers/jackets that are not cross-linked may include thermoplastic elastomers (e.g., composed of EPDM and polypropylene) flame-retarded with one or more organo-phosphorus-based flame retardants, such as poly-2,4-piperazinyl-6-morpholinyl-1,3,5-triazine and/or ammonium polyphosphate. Furthermore, to be considered LSZH according to some embodiments of the invention, the compound contains no halogen per the IEC 60754-1 standard and is deemed to be low smoke when tested under the IEC 61034 standard.

As shown in FIG. 2, the cable 24 includes parallel conductor wires 28, a core 30, a primary jacket 32, a braid 34, and a final jacket 36. As shown in FIG. 3, the cable 26 includes the same components along with an optional barrier layer 38 (such as metallic foil or aluminum foil) between the primary jacket 32 and the braid 34. The conductor wires 28, the core 30, the foil 38, and the braid 34 may be similar in size and composition to those components of the cable 10 of FIG. 1. The braid 34 can act as a heat sink. In particular, the braid 34 can absorb heat from the final jacket 36 when a flame is applied to the cables 24, 26. In order for the braid 34 to act as a heat sink in some embodiments, the final jacket 36 may be formed to the braid 34 in order to create a mated connection having a uniform thermal contact area between the final jacket 36 and the braid 34. The mated connection can provide sufficient thermal contact area between the final jacket 36 and the braid 34 to allow heat applied to the final jacket 36 to transfer to the braid 34. The final jacket 36 may can help provide sufficient flammability protection for the cables 24, 26 in order for the cables 24, 26 to pass a flammability test, including vertical flame tests such as VW-1. The cables 24, 26 can be VW-1 rated in some embodiments. The braid 34 can act as a heat sink for the final jacket 36 and help prevent expansion of the final jacket 36. The mated connection may increase the flammability protection of the cable 24, 26 as compared to other cables formed without a mated connection. For example, cables including final jackets formed with semi-pressure extrusion methods may not have a mated connection.

The final jacket 36 can be formed to the braid 34 in order to create a mated connection between the final jacket 36 and the braid 34. If the final jacket 36 is made using certain methods such as using an extruder with draw down or semi-pressure tooling, a mated connection may not be formed between the final jacket 36 and the braid 34. These methods may cause the final jacket 36 to sit on top of the braid 34, which can decrease the thermal contact area between the final jacket 36 and the braid 34. If the final jacket 36 is made using certain methods such as using an extruder with draw down or semi-pressure tooling, the final jacket 36 may be formed to a predetermined cross-sectional profile. The braid 34 is formed with a pattern that changes a cross-sectional profile (e.g., substantially constantly) of the braid 34 along the length of the cables 24, 26. If the final jacket 36 is made using an extruder with draw down or semi-pressure tooling, the final jacket 36 may not be able to contact the braid 34 in many locations along the length of the cables 24, 26 because the final jacket 36 is not formed to the cross-sectional profile of the braid 34 at a given location. More specifically, thermal contact between the braid 34 and the final layer 36 is dependent on how far radially outward the braid 34 extends at a given location along the length of the cables 24, 26. For example, a first portion 34A of the braid 34 may be positioned below one or more other portions of the braid 34 and thus be positioned radially inward in comparison to a second portion 34B of the braid 34. Even if the final jacket 36 is in thermal contact with the second portion 34B, the final jacket 36 may not be in thermal contact with the first portion 34A, and a mated connection will not be formed between the braid 34 and the final jacket 36 if an extruder with draw down or semi-pressure tooling is used to form the final jacket 36. The first portion 34A can be a portion of a strand of metal or other material included in the braid 34. The second portion 34B can be a portion of another strand of metal or other material included in the braid 34. In some embodiments, the final jacket 36 can be formed to the braid 34 during an extrusion process in order to create the mated connection between the final jacket 36 and the braid 34. When there is a mated connection between the final jacket 36 and the braid 34, the final jacket 36 can be in thermal contact with portions of the braid 34 (e.g., the first portion 34A and the second portion 34B) positioned at different radial locations of the braid 34. In some embodiments, the final jacket 36 can be embedded into the braid 34, and more specifically, portions of the braid 34 (e.g., the first portion 34A and the second portion 34B) positioned at different radial positions in comparison with each other. For example, the final jacket 36 can be embedded into the first portion 34A and the second portion 34B, the first portion 34A being positioned radially inward in comparison to the second portion 34B.

Figure 4A:
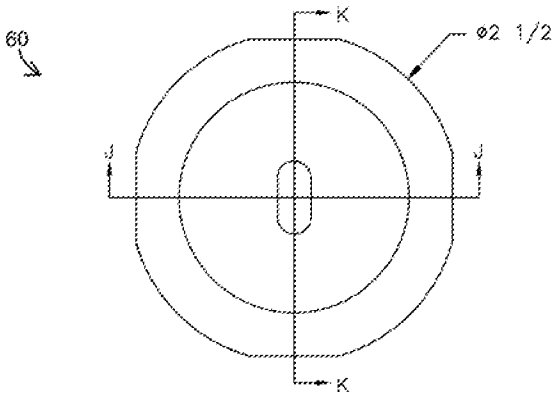
FIG. 4A is a rear view of a die for use with embodiments of the invention.
Figure 4B:
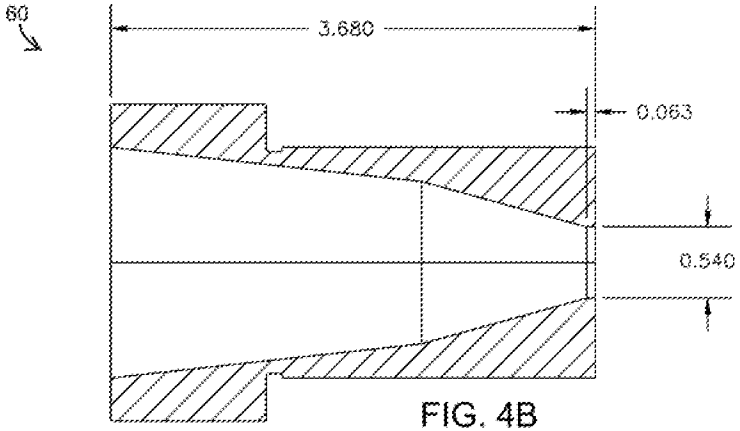
FIG. 4B is a side cross-sectional view of the die of FIG. 4A.
Figure 4C:
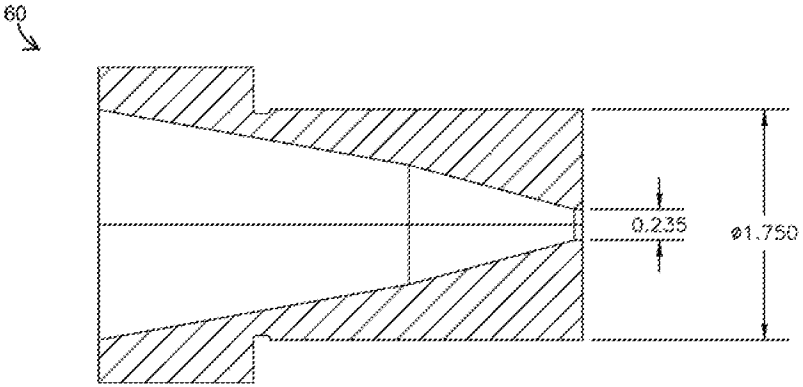
FIG. 4C is a top cross-sectional view of the die of FIG. 4A
Figure 5A:
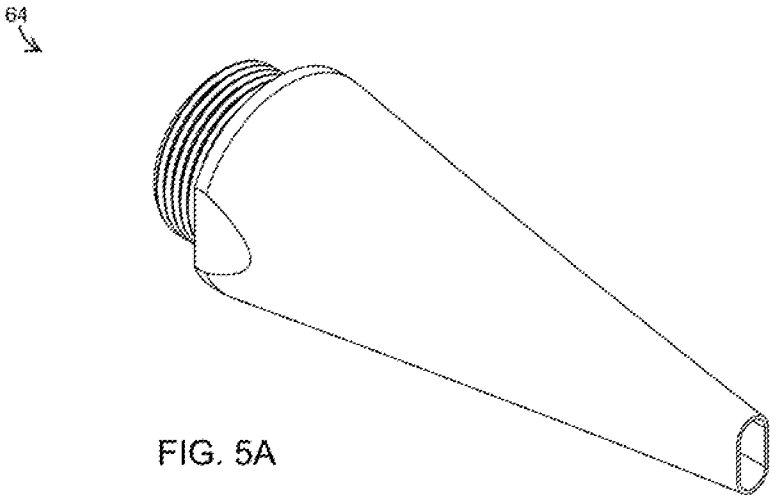
FIG. 5A is a perspective view of a tip for use with embodiments of the invention.
Figure 5B:
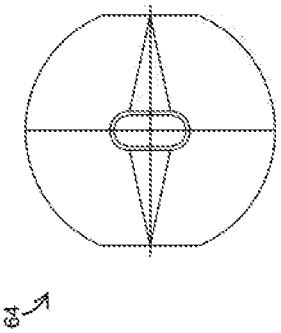
FIG. 5B is a rear view of the tip of FIG. 5A.
Figure 5C:
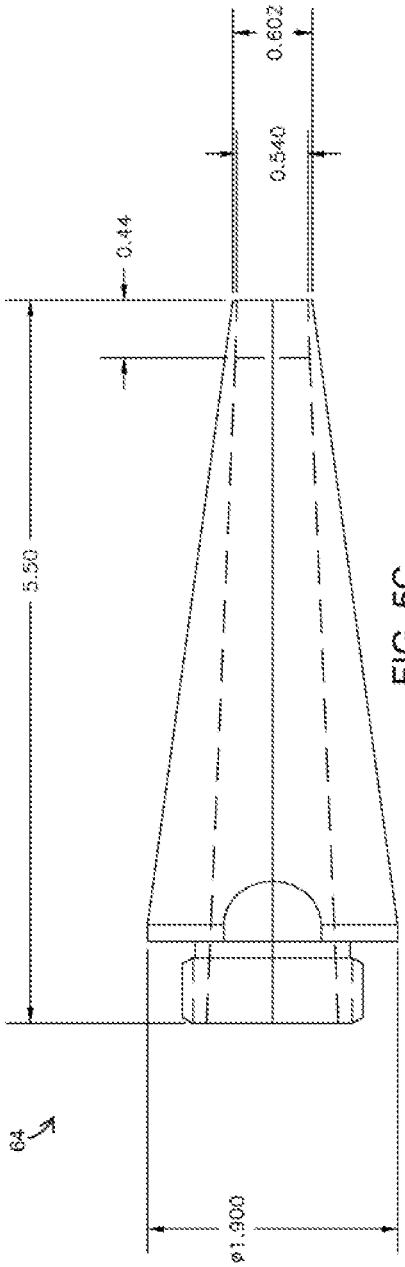
FIG. 5C is a side view of the tip of FIG. 5A.
Figure 5D:
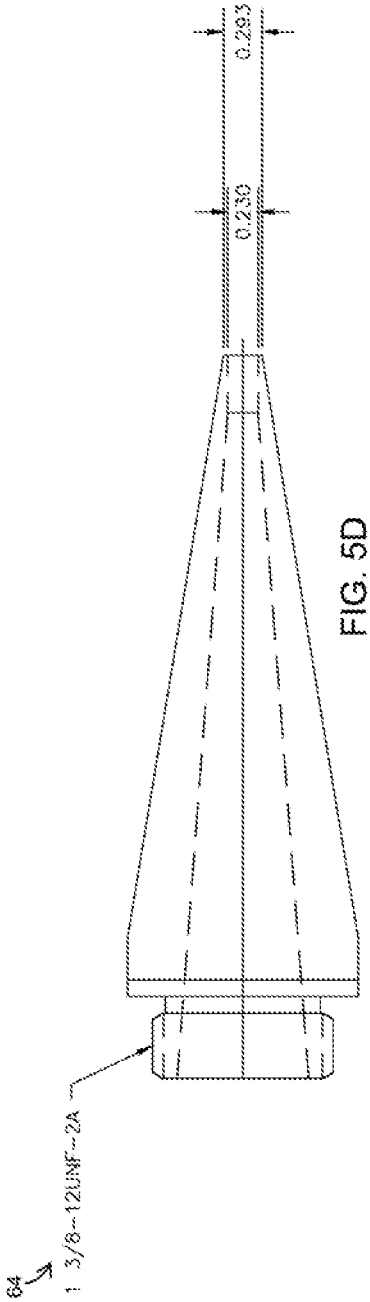
FIG. 5D is a top view of the die of FIG. 5A.
Figure 6A:
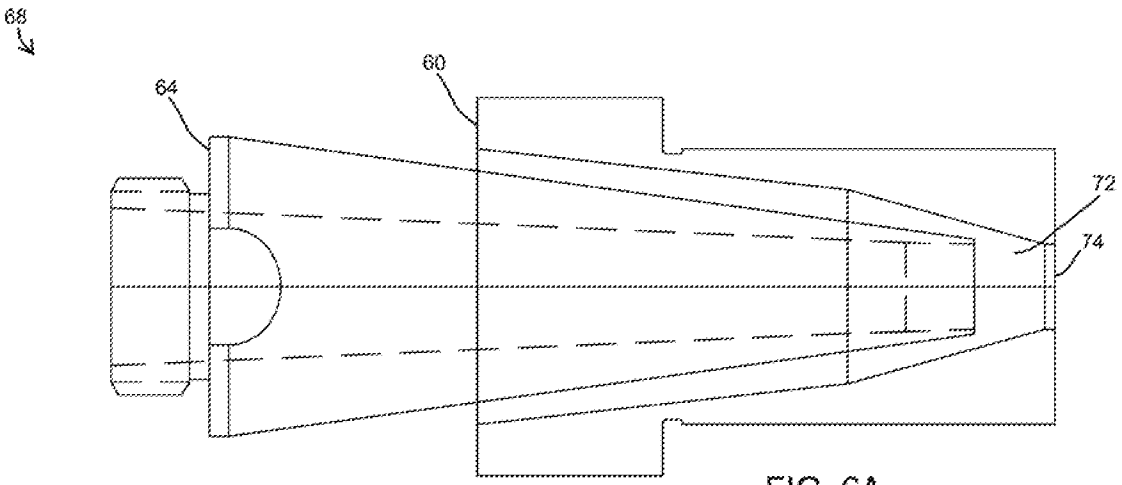
FIG. 6A is a side view of a tip and die assembly for use with embodiments of the invention.
Figure 6B:
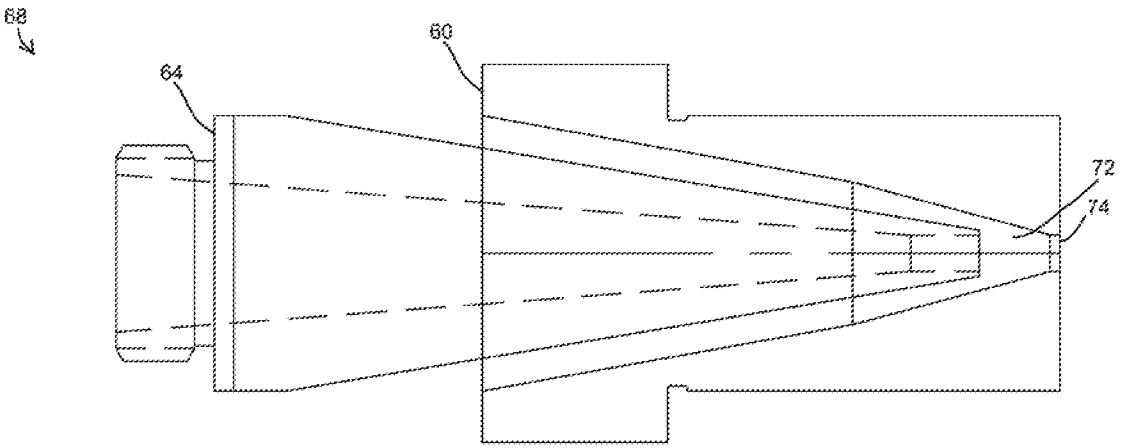
FIG. 6B is a top view of the tip and die assembly of FIG. 6A.

As shown in FIGS. 4-6 in addition to FIGS. 2 and 3, the interaction of the final jacket 36 with the braid 34 can be adjusted during an extrusion process by processing methods that ensure the final jacket 36, while somewhat molten or pliable, is formed to create the mated connection with the braid 34. FIGS. 4A-C show a die 60 and FIGS. 5A-D show a tip 64 for use in this process. In FIGS. 5C and 5D, internal surfaces of the tip 64 are marked with dashed lines. FIGS. 6A-B show a pressure tip and die assembly 68, with portions of the die 60 removed. One embodiment of approximate dimensions of the die 60 and the tip 64 are shown in inches. The pressure tip and die assembly 68 can include the tip 64 and the die 60. More specifically, the pressure tip and die assembly 68 can include the tip 64 inserted into a die-tip cavity 72 of the die 60. The pressure tip and die assembly 68 can be used with a screw manufacturing machine (not shown) in order to form the final jacket 36 to the braid 34.

The adhesion of the final jacket 36 to the braid 34 can be improved by increasing melt pressure in the die-tip cavity 72 of the pressure tip and die assembly 68. One method for increasing the melt pressure in the die-tip cavity 72 is to push the tip 64 further into the die-tip cavity 72 towards a die exit 74. In this way, the braid 34 will be forced into the final jacket 36 and will further penetrate the final jacket 36, increasing adhesion of the jacket 36 to the braid 34. However, if the braid 34 is forced into the final jacket 36 too much, the final jacket 36 may not be thick enough to pass certain mechanical tests such as impact resistance, so the distance the tip 64 is inserted into the die 60 toward the die exit 74 can be limited accordingly.

The final jacket 36 can be made using an extruder with pressure tooling such as the pressure tip and die assembly 68 in order to force the molten polymer pumped by the extruder to wrap the surface of the braid 34 when the final jacket 36 is inside the flow channel between a die (i.e., the die 60) and a tip (e.g., the tip 64) of the extruder. In other embodiments, the final jacket 36 can be made using vacuum extrusion. Extrusion using pressure tooling may be more desirable than vacuum extrusion because the LSZH materials used to form the final jacket 36 are generally highly filled and viscous, which can make it more difficult to conform the final jacket 36 to the braid 34 using vacuum extrusion for tube-down extrusion. Additionally or alternatively, the final jacket 36 can be made using an extruder with post extrusion compression or forming to press the final jacket 36 into the braid 34. In some embodiments, the post extrusion compression can include the application of multiple rollers to the somewhat pliable final jacket 36 in order to press the final jacket 36 into the braid 34. Forming the final jacket 36 to the braid using processes including using an extruder with pressure tooling, using vacuum extrusion, or using an extruder with post extrusion compression or forming as described above may cause the jacket 36 to be harder to strip, and therefore increase the difficulty of installing the cable 24, 26. However, for certain applications such as pipe heating (i.e., in oil and gas and/or mining industries), the additional flammability protection afforded by the forming of the jacket 36 to the braid 34 may be desirable even with the potential difficulty in installing the heating cable 24, 26.

Referring to FIG. 3, once the final jacket 36 is formed in mated connection with the braid 34, the final jacket 36 can thermally contact multiple overlapping portions of the braid 34. More specifically, the final jacket 36 can be in thermal contact with the first portion 34A and the second portion 34B of the braid. Even though the first portion 34A is arranged below the second portion 34B, the final jacket 36 can thermally contact a sufficient portion of the braid in order to achieve the mated connection as a result of an appropriate forming process such as pressure extrusion, vacuum extrusion, or extrusion with post extrusion compression or forming, such as applying multiple rollers to the final jacket 36 after extrusion. In some embodiments, the final jacket 36 can be configured to conduct an approximately equal amount of heat to the first portion 34A and the second portion 34B, despite the different radial positions of the first portion 34A and the second portion 34B. In some embodiments, the amount of heat conducted to the first portion 34A may be within about twenty percent of the amount heat conducted to the second portion 34B.

Figure 7:
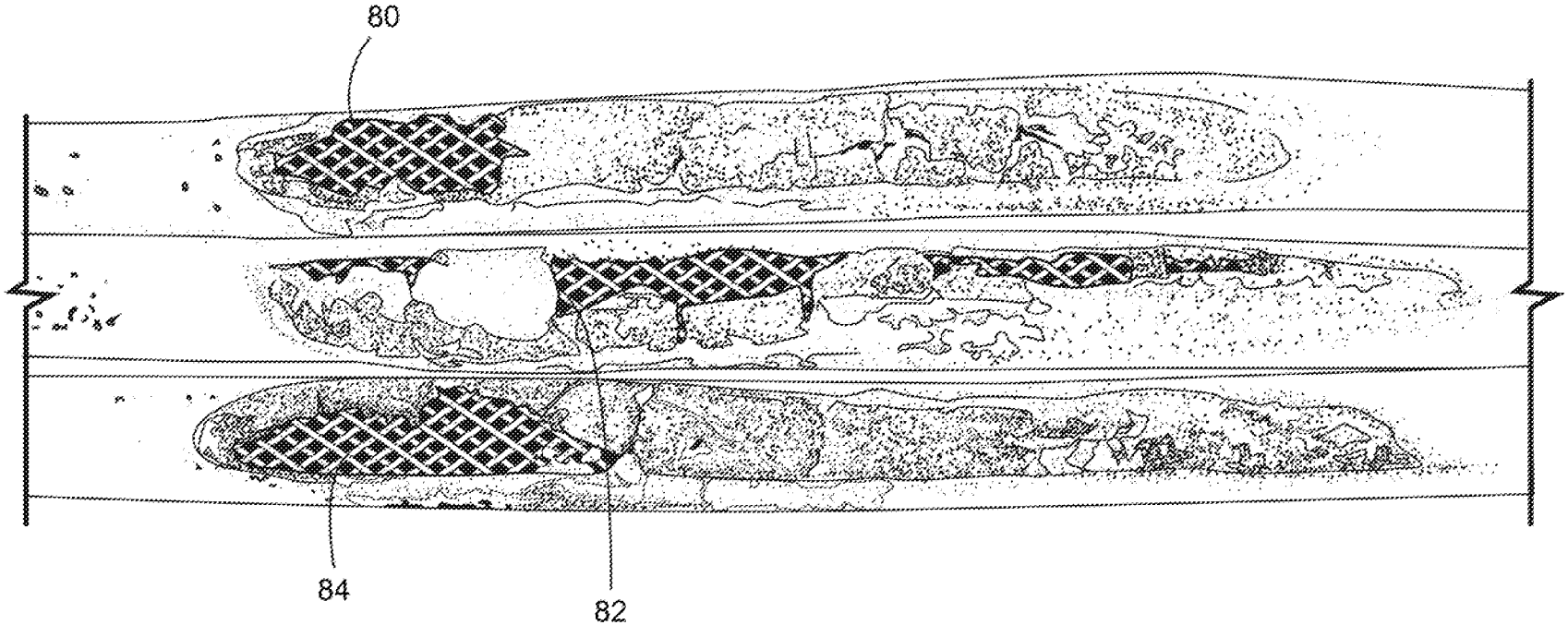
FIG. 7 is an illustration of results of a cable flame test.
Figure 8:
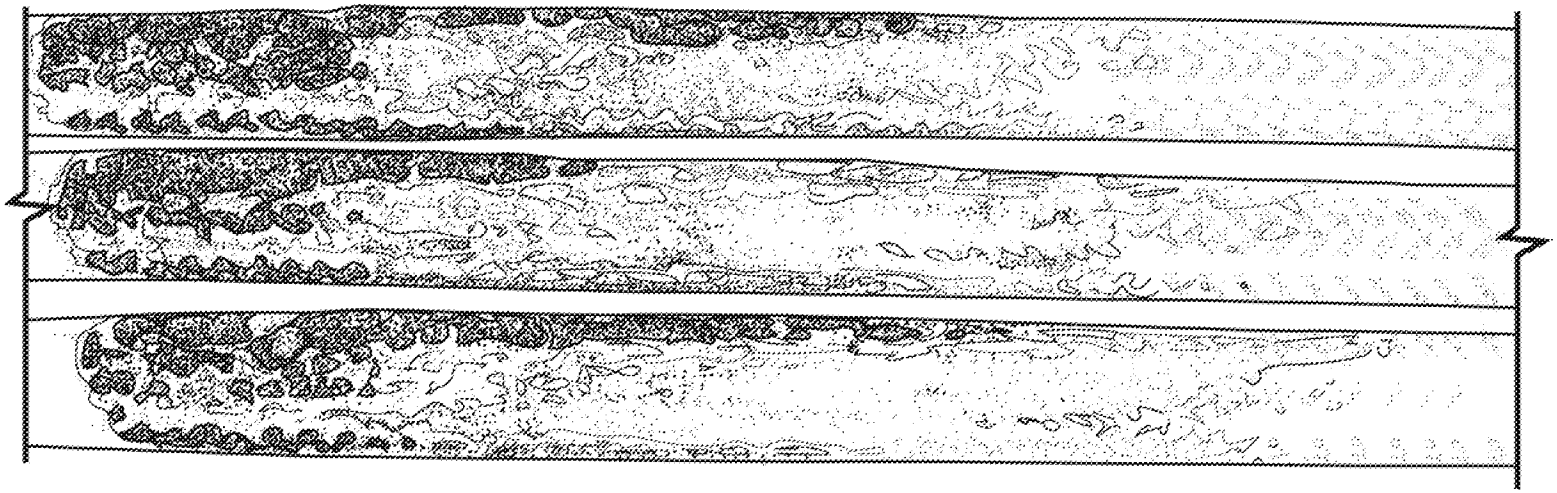
FIG. 8 is an illustration of results of another cable flame test.

FIGS. 7 and 8 illustrate cables subjected to a flame test. In FIG. 7, the cables were made with an extruder and semi-pressure tooling. In FIG. 8, the cables were made with an extruder and pressure tooling to form the final jackets to the braids in order to create a mated connection between the final jackets and the braid. All cables were made with LSZH materials. All cables were subjected to a vertical flame test with five applications of flame for a duration of fifteen seconds. Between each application of flame, the flame is removed and the cables are allowed to cool down for fifteen seconds. Tables 1 and 2 below provide the results of the tests of the cables made with semi-pressure tooling and pressure tooling. The after burn time is the duration of time the cable was on fire after the flame was removed after each flame application. The cables made with semi-pressure tooling were ignited on the first or second flame application, forming a char layer, while the cables made with pressure tooling were not ignited until the third or fourth flame application. The final jackets of the cables made with semi-pressure tooling expanded during the first flame application, which made the final jackets lose contact with the braids, which prevented the braids from acting as a heat sink. Additionally, the final jackets of the cables made with semi-pressure tooling were burned through by the end of testing, exposing the braid and other layers. As shown in FIG. 7, each cable made with semi-pressure tooling had a braid 80, 82, 84 exposed as a result of the flame applications. The final jackets of the cables made with pressure tooling did not freely expand, and remained intact throughout the testing. The cables made with pressure tooling provided superior flammability protection as compared to the cables made with semi-pressure tooling. While the final jackets of the cables were constructed with LSZH materials, other types of flame retarded jackets than LSZH may benefit from being formed to the braid in order to create the mated connection between the final jacket and the braid.

TABLE 1

| Product Description | Application 1 After Burn Time (Seconds) | Application 2 After Burn Time (Seconds) | Application 3 After Burn Time (Seconds) | Application 4 After Burn Time (Seconds) | Application 5 After Burn Time (Seconds) | Burn >25% Paper (Yes/No) | Pass/Fail |
|---|---|---|---|---|---|---|---|
| Semi-Pressure Cable 1 | 1 | 4 | 9 | 3 | 0 | No | Pass |
| Semi-Pressure Cable 2 | 2 | 15 | 3 | 1 | 0 | No | Pass |
| Semi-Pressure Cable 3 | 1 | 15 | 15 | 10 | 0 | No | Pass |

TABLE 2

| Product Description | Application 1 After Burn Time (Seconds) | Application 2 After Burn Time (Seconds) | Application 3 After Burn Time (Seconds) | Application 4 After Burn Time (Seconds) | Application 5 After Burn Time (Seconds) | Burn >25% Paper (Yes/No) | Pass/Fail |
|---|---|---|---|---|---|---|---|
| Pressure Cable 1 | 0 | 0 | 0 | 15 | 26 | No | Pass |
| Pressure Cable 2 | 0 | 0 | 0 | 15 | 1 | No | Pass |
| Pressure Cable 3 | 0 | 0 | 15 | 6 | 0 | No | Pass |

Figure 9:
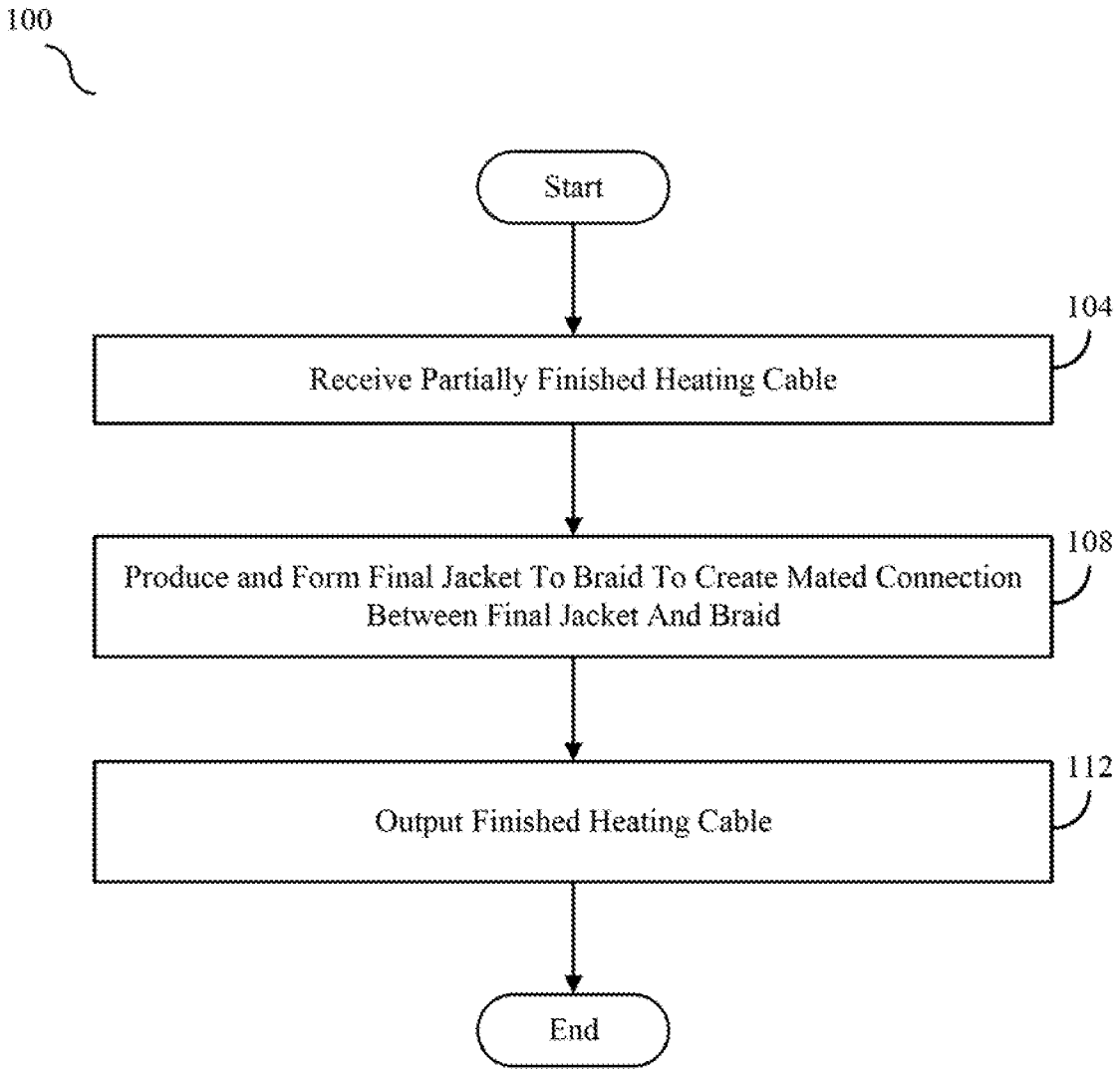
FIG. 9 is a manufacturing process for producing a heating cable according to some embodiments of the invention.

FIGS. 2, 3, and 6 as well as FIG. 9 illustrate a manufacturing process 100 for producing a heating cable having increased flammability protection according to some embodiments of the invention. The heating cable can be the cable 24 or the cable 26 of FIGS. 2 and 3. The manufacturing process 100 can be used to produce a cable having a final jacket, for example the final jacket 36, formed to a braid, for example the braid 34, in order to create a mated connection between the final jacket 36 and the braid 34 in order to increase the flammability protection of the heating cable.

As shown in FIG. 9, the manufacturing process 100 can receive (at 104) a partially finished heating cable including parallel conductor wires 28, the core 30, the primary jacket 32, and the braid 34. The partially finished heating cable may include the optional barrier layer 38.

The manufacturing process 100 can produce and form (at 108) the final jacket 36 to the braid 34 to create the mated connection between the final jacket 36 and the braid 34. The final jacket can be formed using LSZH materials that may include a polyolefin flame-retarded with inorganic hydrated mineral fillers. In some embodiments, the forming of the final jacket 36 to the braid 34 to create the mated connection between the final jacket 36 and the braid 34 can include forming the final jacket 36 to the braid 34 using an extruder with pressure tooling. More specifically, the final jacket 36 can be made using an extruder with pressure tooling in order to force the molten polymer pumped by the extruder to wrap the surface of the braid 34 when the final jacket 36 is inside the flow channel between a die and a tip of the extruder. In some embodiments, the extruder with pressure tooling can include the pressure tip and die assembly 68. In some embodiments, the forming of the final jacket 36 to the braid 34 to create the mated connection between the final jacket 36 and the braid 34 can include producing and forming the final jacket 36 to the braid 34 using vacuum extrusion. In some embodiments, the forming of the final jacket 36 to the braid 34 to create the mated connection between the final jacket 36 and the braid 34 can include producing and forming the final jacket 36 to the braid 34 using an extruder with post extrusion compression or forming to press the final jacket 36 into the braid 34. The post extrusion compression or forming can include applying multiple rollers to the final jacket 36 after extrusion while the final jacket 36 is still somewhat pliable. After forming the final jacket 36, the heating cable (e.g., the cable 24 or the cable 26 described above) may be allowed to cool off for a predetermined time period in order to allow the final jacket 36 to fully solidify before the heating cable can be handled and/or used in an application such as pipe heating.

The manufacturing process 100 can output (at 112) a finished heating cable including the parallel conductor wires 28, the core 30, the primary jacket 32, the braid 34, and the final jacket 36 formed to the braid 34 and having a mated connection with the braid 34. The finished heating cable can have increased flammability protection as a result of mated connection by causing the braid 34 to act as a heat sink for the final jacket 36 and help to prevent the final jacket 36 from expanding away from the braid 34 during a flame application. The finished heating cable can optionally include the barrier layer 38.

While the LSZH self-regulating heating cables 24, 26 described above are monolithic self-regulating heating cables (that is, having a solid conductive core 30), the principles of the invention may be used with fiber-wrap self-regulating heating cables.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. For example, any of the features or functions of any of the embodiments disclosed herein may be incorporated into any of the other embodiments disclosed herein.

The invention claimed is:

1. A self-regulating heating cable comprising:
- a semi-conductive heating core;
- two conductive wires embedded within and separated by the semi-conductive heating core;
- a primary jacket surrounding the semi-conductive core and comprising a first low-smoke, zero halogen material;
- a braid surrounding the primary jacket; and
- a final jacket surrounding the braid and including a second low-smoke, zero halogen material, the final jacket formed to the braid during an extrusion process in order to create a mated connection between the final jacket and the braid.

2. The self-regulating heating cable of claim 1, wherein the final jacket is formed to the braid using an extruder with pressure tooling, and wherein the mated connection increases the flammability protection of the cable.

3. The self-regulating heating cable of claim 1, wherein the final jacket is formed to the braid using vacuum extrusion.

4. The self-regulating heating cable of claim 1, wherein the final jacket is formed to the braid using an extruder with post extrusion compression.

5. The self-regulating heating cable of claim 1, wherein the final jacket is formed to a cross-sectional profile of the braid.

6. The self-regulating heating cable of claim 5, wherein the cross-sectional profile changes along a length of the self-regulating heating cable, and the final jacket is formed to the braid to create the mated connection along the length of the self-regulating heating cable.

7. The self-regulating heating cable of claim 1, wherein the braid comprises copper, and wherein at least one of the first and second low-smoke, zero halogen materials includes a polyolefin flame-retarded with inorganic hydrated mineral fillers.

8. The self-regulating heating cable of claim 1, and further comprising a barrier layer surrounding the primary jacket, the braid surrounding the barrier layer.

9. The self-regulating heating cable of claim 8, wherein the barrier layer comprises aluminum foil.

10. The self-regulating heating cable of claim 1, wherein the self-regulating heating cable is VW-1 rated.

11. A self-regulating heating cable comprising:
- a primary jacket comprising a first low-smoke, zero halogen material;
- a braid surrounding the primary jacket; and
- a final jacket surrounding the braid and comprising a second low-smoke, zero halogen material, the final jacket formed to the braid during an extrusion process in order to create a mated connection between the final jacket and the braid.

12. The self-regulating heating cable of claim 11, wherein the braid comprises a first portion and a second portion, the first portion being positioned below the second portion, and wherein the final jacket is configured to conduct an approximately equal amount of heat to the first portion and the second portion.

13. The self-regulating heating cable of claim 12, wherein the amount of heat conducted to the first portion is within about twenty percent of the amount heat conducted to the second portion.

14. The self-regulating heating cable of claim 12, wherein at least one of the first and second LSZH materials comprises a polyolefin flame-retarded with inorganic hydrated mineral fillers.

15. The self-regulating heating cable of claim 11, wherein the braid comprises a metal and provides a ground path.

16. The self-regulating heating cable of claim 11, wherein the final jacket is formed to the braid using an extruder with pressure tooling, and wherein the mated connection increases the flammability protection of the cable.

17. A manufacturing process for producing a heating cable, the manufacturing process comprising:
- receiving a partially finished heating cable comprising parallel conductor wires, a core, a primary jacket, and a braid;
- forming a final jacket to the braid to create a mated connection between the final jacket and the braid; and
- outputting a finished heating cable including the parallel conductor wires, the core, the primary jacket, the braid, and the final jacket.

18. The manufacturing process of claim 17, wherein forming the final jacket to the braid to create the mated connection between the final jacket and the braid comprises forming the final jacket to the braid using an extruder with pressure tooling, and wherein the finished heating cable has increased flammability protection as a result of mated connection.

19. The manufacturing process of claim 17, wherein forming the final jacket to the braid to create the mated connection between the final jacket and the braid comprises forming the final jacket to the braid using an extruder with post extrusion compression to press the final jacket into the braid.

20. The manufacturing process of claim 17, wherein forming the final jacket to the braid to create the mated connection between the final jacket and the braid comprises forming the final jacket to the braid using vacuum extrusion.

* * * * *